US009500000B2

(12) United States Patent
McCarty et al.

(10) Patent No.: US 9,500,000 B2
(45) Date of Patent: Nov. 22, 2016

(54) FENCING PANEL AND METHOD OF ASSEMBLY

(71) Applicants: James E. McCarty, Palmer, TX (US); Kurt Rathjen, Dallas, TX (US)

(72) Inventors: James E. McCarty, Palmer, TX (US); Kurt Rathjen, Dallas, TX (US)

( * ) Notice: Subject to any disclaimer, the term of this patent is extended or adjusted under 35 U.S.C. 154(b) by 97 days.

(21) Appl. No.: 14/550,340

(22) Filed: Nov. 21, 2014

(65) Prior Publication Data

US 2016/0145891 A1 May 26, 2016

(51) Int. Cl.

| | |
|---|---|
| ***E04H 17/00*** | (2006.01) |
| ***E04H 17/14*** | (2006.01) |
| ***E04H 17/20*** | (2006.01) |
| ***E04H 17/22*** | (2006.01) |
| ***E04H 17/16*** | (2006.01) |

(52) U.S. Cl.

CPC ..... *E04H 17/14* (2013.01); *E04H 17/165* (2013.01); *E04H 17/20* (2013.01); *E04H 17/22* (2013.01); *E04H 2017/1447* (2013.01)

(58) Field of Classification Search

CPC ..... Y10T 29/49616; Y10T 29/49947; Y10T 29/49966; Y10T 29/49968; Y10T 29/4997; Y10T 29/49998; E04H 17/14; E04H 17/20; E04H 17/22; E04H 2017/1447

USPC ..... 256/24, 65.01, 65.02, 65.03, 65.04, 256/65.12, 65.14, 69; 29/248, 525.01

See application file for complete search history.

(56) References Cited

U.S. PATENT DOCUMENTS

| | | | | |
|---|---|---|---|---|
| 1,225,431 | A * | 5/1917 | Gelbart | 5/285 |
| 2,592,722 | A * | 4/1952 | Noll | 160/328 |
| 3,101,929 | A * | 8/1963 | Dvore | 256/24 |
| 3,946,992 | A * | 3/1976 | Elias | 256/58 |
| 3,995,833 | A * | 12/1976 | McLaughlin et al. | 256/59 |
| 4,526,348 | A * | 7/1985 | Cammack | 256/65.06 |
| 5,026,028 | A * | 6/1991 | Ooi et al. | 256/67 |
| 5,494,261 | A * | 2/1996 | Gandara | 256/24 |
| 5,628,495 | A * | 5/1997 | Gandara | 256/24 |
| 5,645,271 | A * | 7/1997 | Nunez | 256/67 |
| 5,876,075 | A | 3/1999 | Barthelmess | |
| 5,961,242 | A * | 10/1999 | Leone | 403/234 |
| 6,038,829 | A * | 3/2000 | Franks | 52/645 |
| 6,802,496 | B1 * | 10/2004 | Preta | 256/65.04 |
| 7,040,605 | B2 * | 5/2006 | Lappen | 256/10 |
| 7,063,186 | B1 * | 6/2006 | Granke | 182/113 |
| 7,500,655 | B1 * | 3/2009 | Smith et al. | 256/67 |
| 2003/0132427 | A1 * | 7/2003 | Allenbaugh | 256/65.14 |
| 2006/0033093 | A1 * | 2/2006 | Lo | 256/65.02 |
| 2006/0192192 | A1 * | 8/2006 | Hammond et al. | 256/65.04 |
| 2011/0024708 | A1 | 2/2011 | Arden | |
| 2013/0277634 | A1 * | 10/2013 | Munyon | E04H 17/1421 256/67 |

* cited by examiner

*Primary Examiner* — Gregory Binda
*Assistant Examiner* — Nahid Amiri
(74) *Attorney, Agent, or Firm* — David G. Henry, Sr.

(57) ABSTRACT

A dynamically adjustable fencing system that includes a first support post having a first pair of arms extending therefrom, a second support post having a second pair of arms extending therefrom, and a crossmember pivotally coupled at a crossmember first end to the first support post via the first pair of arms, and further pivotally coupled at a crossmember second end to the second support post via the second pair of arms, thereby enabling dynamic crossmember adjustability of the crossmember.

7 Claims, 6 Drawing Sheets

FENCING PANEL AND METHOD OF ASSEMBLY

TECHNICAL FIELD

The present disclosure relates to a fencing panel and method of assembly thereof. More particularly, it is concerned with a fencing panel that enable support posts to remain perpendicular while allowing enhanced contouring of crossmembers with the terrain.

BACKGROUND

Fencing panels may be used for various functions, including fencing a plot of land to keep people, vehicles, and/or animals on or off of the land. As depicted in FIG. 1A, a typical fence 100 may be comprised of multiple individual fencing panels 102 (shown as fencing panels 102*a-g*). Each fencing panel 102 may include a first support post 104 (labeled as first support posts 104*a-g*) and a second support post 106 (labeled as a second support post 106*a-g*), and a plurality of crossmembers 108 (e.g., crossmembers 108*a*) therebetween. One of the support posts 104, 106 will have one or more hooks 110. As depicted, two hooks 110 are arranged on each of the first support posts 104*a-g*. Each fencing panel 102*a-g* further includes one or more receiving loops 112. As depicted, two receiving loops 112 are arranged on the second support post 106 of each fencing panel 102. The hooks 110 of one panel 102 are to be arranged within the receiving loops 112 of another panel, thereby coupling the panels together. An enlarged view of this is illustrated in FIG. 1B. This configuration, however, presents many problems.

For example, due to the rigidity of the crossmembers 108 coupled to the support posts 104, 106, the panel 102*a-g* is unable to flex with uneven terrain, thus leaving gaps between the panels 102*a-c*, especially upon slopes, peaks, and troughs of land. As depicted, the hill or peak 114 of land slopes the two panels 102*c* and 102*d* in opposite directions, therefore not enabling the hooks 110*d* to be arranged within the receiving loops 112*c*. Resulting therefrom, a gap 116 is formed, where animals may be able to escape, or alternatively be caught therein and unable to be freely released. Different animals may react in different manners to being caught, such as a horse pulling back when stuck, but a cow may try to push through the panels 102*c* and 102*d*, thereby moving and/or breaking them, along with injuring the animal itself.

Similar issues arise at the trough or low point of land 118. As depicted, the panels 102*f* and 102*g* are only partially able to connect via the hook 110*g* and receiving loop 112*f* due to being at various angles when conforming to the land. Such an arrangement creates a gap 120 between the two panels 102*f* and 102*g*. Again, animals may be able to escape through the gap 120, or alternatively become stuck in the gap 120, possibly causing injury or death to the animal, and damage to the fencing panels 102*f* and 102*g*. Current solutions are to arrange additional panels 102 in areas which such gaps 116, 120 occur. However, such a solution is both costly (due to the extra panels 102 required to be purchased), and may prove ineffective over a period of time as the land continues to move and shift. Accordingly, a fencing panel which solves the aforementioned problems remains highly desirable.

SUMMARY OF THE INVENTION

The present disclosure introduces various illustrative embodiments for a fencing panel, and method of assembly thereof, that enable support posts to remain perpendicular while allowing enhanced contouring of crossmembers with the terrain.

It is an object of the present disclosure to provide a fencing panel that includes a first support post having a first pair of arms radially extending therefrom, each arm having a hole horizontally arranged therethrough at substantially the same location, and a second support post having a second pair of arms radially extending therefrom, each arm having a hole horizontally arranged therethrough at substantially the same location. The fencing assembly further including a first crossmember having a first end and a second end, each end having a horizontal hole therethrough, where a means for coupling the crossmember to a support post is employed at each end of the crossmember to couple the crossmember to each support post via the associated holes in the ends of the crossmember and holes in the arms of each support post.

It is another object of the present disclosure to provide a method for assembling a fencing panel, wherein the method employs a means for coupling a crossmember to a support post to couple a first end of a first crossmember to a first support post via holes in a first pair of arms radially extending from the first support post and a hole in the first end of the first crossmember, and further employs the means for coupling a crossmember to a support post to couple a second end of the first crossmember to a second support post via holes in a second pair of arms radially extending from the second support post and a hole in the second end of the first crossmember. Advantageously, such a configuration enables the support posts to remain perpendicular while allowing enhanced contouring of crossmembers with the terrain.

BRIEF DESCRIPTION OF THE DRAWINGS

The following figures are included to illustrate certain aspects of the present invention, and should not be viewed as an exclusive embodiments. The subject matter disclosed is capable of considerable modification, alteration, and equivalents in form and function, as will occur to one having ordinary skill in the art and the benefit of this disclosure.

DETAILED DESCRIPTION

Figure 1A:
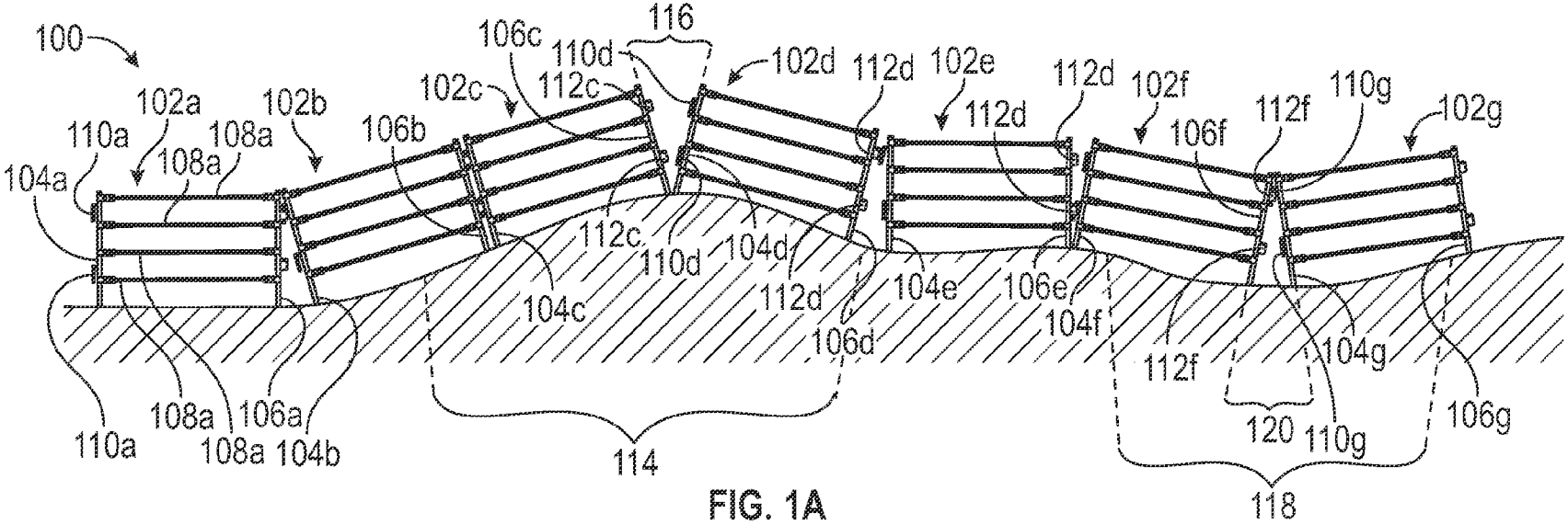
FIG. 1A (Prior Art)
FIGS. 1A and 1B depict a plurality of prior-art fencing panels.

The present disclosure relates to a fencing panel and method of assembly thereof. More particularly, it is concerned with a fencing panel that enable support posts to remain perpendicular while allowing enhanced contouring of crossmembers with the terrain, thereby preventing gaps between panels from occurring.

Referring now to the drawings, wherein like reference numbers are used herein to designate like elements throughout the various views and embodiments of a unit. The figures are not necessarily drawn to scale, and in some instances the drawings have been exaggerated and/or simplified in places for illustrative purposes only. One of the ordinary skill in the art will appreciate the many possible applications and variations based on the following examples of possible embodiments. As used herein, the "present disclosure" refers to any one of the embodiments described throughout this document and does not mean that all claimed embodiments must include the referenced aspects.

Figure 2:
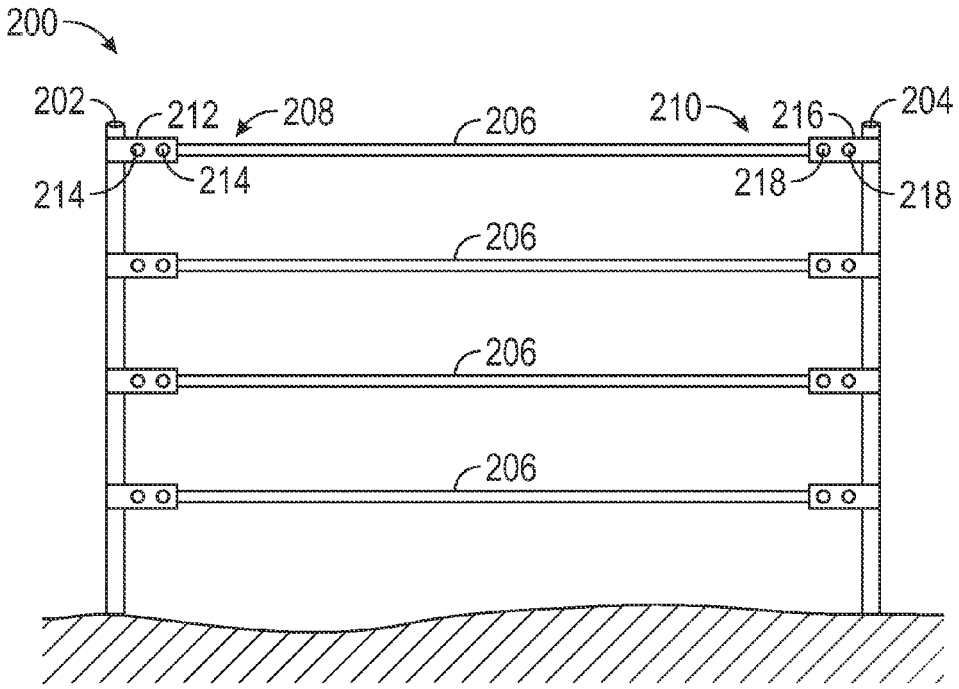
FIG. 2 illustrates a side view of a fencing panel, according to one or more embodiments.

FIG. 2 illustrates a side view of a fencing panel 200, according to one or more embodiments. As depicted, the panel 200 includes a first support post 202, a second support post 204, and a plurality of crossmembers 206 (four shown) coupled therebetween. Each crossmember 206 includes a first end 208 and a second end 210, both ends 208 and 210 having at least one hole (not shown) arranged horizontally therethrough. The crossmembers 206 may be, for example, 12 feet in length. While four crossmembers 206 are shown, one of skill in the art will appreciate that more or less than four crossmembers 206 may be employed, of which may be longer or shorter than 12 feet, in other embodiments and are contemplated herein without departing from the scope of the disclosure.

Described in further detail below (FIG. 3), briefly, the first support post 202 includes a pair of arms 212 radially extending therefrom, wherein each arm 212 of the pair includes at least one hole 214 arranged therethrough (two holes 214 shown). The second support post 204 similarly includes a pair of arms 216 radially extending therefrom, wherein each arm 216 includes at least one hole 218 arranged therethrough. A means for coupling the crossmember to the support posts 202, 204 is employed at each end of the crossmember 206, thereby coupling the crossmember 206 to the support posts 202, 204 via the associated holes in each end 208,210 of the crossmember and holes 214, 218 in the arms 212, 216 of each support post 202,204.

Figure 3:
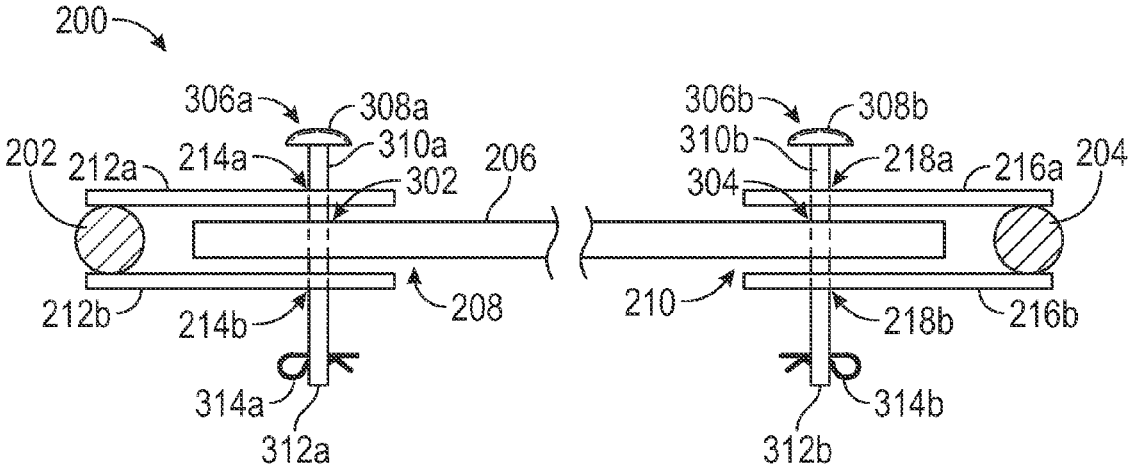
FIG. 3 illustrates a top-down view of the fencing panel, according to one or more embodiments.

FIG. 3 illustrates a top-down view of the fencing panel 200, according to one or more embodiments. As depicted, the fencing panel 200 includes the first support post 202 (for visual purposes only, depicted on the left) which has a pair of arms (a first arm 212*a* and a second arm 212*b*) coupled thereto. Each arm 212*a* and 212*b* includes a hole 214*a*, 214*b* arranged therethrough, wherein the holes 214*a* and 214*b* are arranged at substantially the same location (i.e., substantially the same distance from the first support post 202) in each arm 212*a* and 212*b*.

The fencing panel 200 further includes the second support post 204 (for visual purposes only, depicted on the right) which has a pair of arms (a first arm 216*a* and a second arm 216*b*) coupled thereto. Each arm 216*a* and 216*b* has a hole 218*a*, 218*b* arranged therethrough, wherein the holes 218*a* and 218*b* are arranged at substantially the same location (i.e., substantially the same distance from the second support post 204). FIG. 3 also depicts the crossmember 206 having a first hole 302 horizontally arranged near the first end 208 and a second hole 304 horizontally arranged near the second end 210.

In some embodiments, the arms 212 and 216 may be approximately 6 inches long, and each arm 212*a*, 212*b*, 216*a*, 216*b* may be a thickness ranging from approximately 3/16 inch to 1 inch. Moreover, for embodiments including a plurality of holes (e.g., holes 214*a*, 214*b*, 218*a*, 218*b*) in each arm, the holes may be spaced approximately 2 inches apart. In other embodiments, the holes may be spaced equally or unequally in distance, as may be appropriate or necessary for coupling of the crossmember 206 to the arms 214, 218. In further embodiments, the support posts 202, 204 may be constructed of a variety of materials, such as a metal (e.g., steel). The support posts 202, 204 are preferably of a larger gauge, such as 11 or 12 gauge. However, in other embodiments, the support posts 202, 204 may range from 18 gauge to 22 gauge, and, while lighter in weight, the thinner construction may result in decreased durability and strength.

A means for coupling the crossmember 206 to each support post 202, 204 is employed at each end 208, 210 of the crossmember 206 to couple the crossmember 206 to each support post 202, 204 via the associated holes 302, 304 in the ends of the crossmember and holes 214, 218 in the arms of each support post. Such a means for coupling the crossmember 206 to each support post 202, 204 may include, for example and without limitation, a lynch pin 306*a,b* (two depicted as 306*a* and 306*b*) having a head 308, a body 310, and an end 312, and a cotter pin 314.The head 308 is generally larger in diameter than the hole (e.g. hole 214 or 302) which the body 310 will be arranged through, thereby securing the head 306 on one side of the arm 212 or 214.

In exemplary operation, the first end 208 of the crossmember 206 may be coupled to the first support post 202 via the first pair of arms 212*a,b*. The lynch pin body 310*a* may be conveyed through the hole 214*a* in the first arm 212*a*, through the hole 302 in the first end 208 of the crossmember 206, and through the hole 214*b* in the second arm 212*b*, wherein the end 312*a* of lynch pin 306*a* is secured from removal by coupling of the cotter pin 314*a* thereto. In other embodiments, the means may operate to convey the lynch pin body 310 in a reverse order, while still accomplishing the goal of coupling the crossmember 206 to the first pair of arms 212*a,b*.

Similarly, the means can also be employed for coupling the second end 210 of the crossmember 206 to the second support post 204 via the second pair of arms 216, wherein a second lynch pin 306*b* and second cotter pin 312*b* are employed. In such an embodiment, the body 310*b* of the second lynch pin 306*b* is arranged through the hole 218*a* of first arm 216*a*, through the hole 304 at the second end 210 of the crossmember 206, and through the hole 218*b* of the second arm 216*b*, whereby the lynch pin 306*b* is secured from removal by coupling of the second cotter pin 314*b* to the end 312*b* thereof.

Figure 1B:
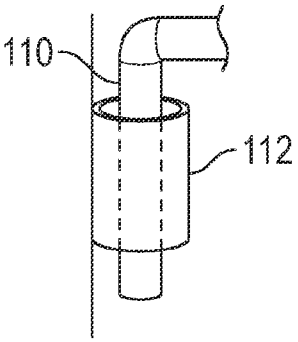
FIG. 1B (Prior Art)

Advantageously, such a means for hingedly coupling the crossmember 206 to the support posts 202, 204 enables the fencing panel to be arranged on uneven terrain, while allowing the support posts 202 to remain perpendicular, but enabling angular arrangement of the crossmembers 206. Therefore, the crossmember 206 may run parallel to the terrain, even when at an angle. Further advantageous is the reduction or alleviation of gaps (e.g. gap 116 and gap 120 shown in FIG. 1) due to the support posts remaining perpendicular. Even further advantageous are discussed below, for example, in FIG. 5.

Figure 4A:
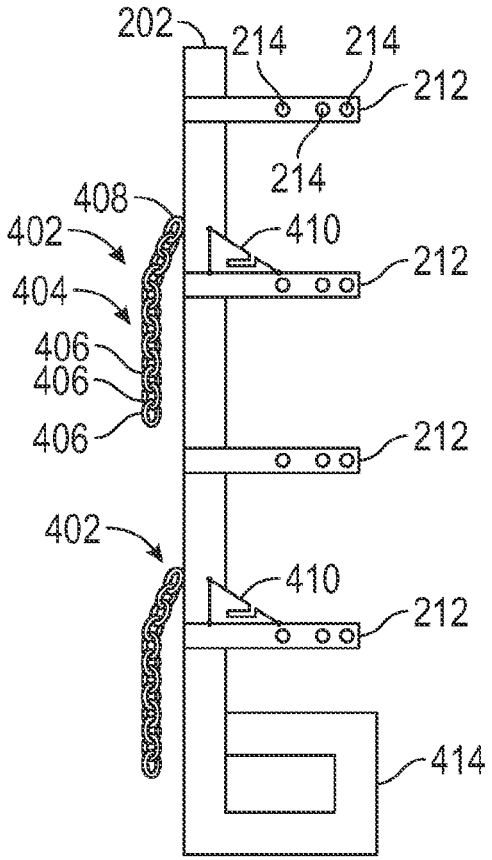
FIGS. 4A and 4B shows enlarged views of the fencing panel support post, according to one or more embodiments.
Figure 4B:
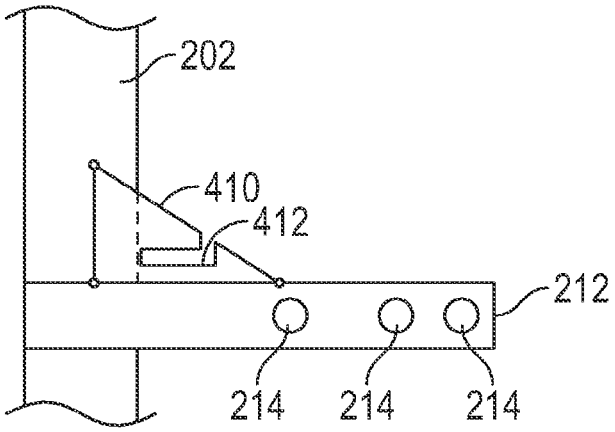

FIGS. 4A and 4B shows enlarged views of the fencing panel support post 202, according to one or more embodiments. In FIG. 4A, the first support post 202 is depicted, an embodiment of which includes four arms 212, each arm 212 having three holes 214 therethrough. Also disclosed and depicted is a means 402 for securing together a plurality of fencing panels (e.g. panel 202, FIG. 2). Such a means 402 may include, for example and without limitation, a chain 404 having a plurality of chain links 406 (three labeled). In some embodiments, the chain 404 is welded at one point to the support post 202 at location 408, whereas the rest of the chain is free to be wrapped around the support post of another fencing panel, thus joining the two fencing panels together. Advantageously, such welding would prevent loss of the chain. Moreover, welding is generally animal friendly, as there are fewer (if any) sharp edges for an animal to cut themselves on.

In other embodiments, however, the means 402 may be tied, screwed, bolted, or the like to the support post 202. Where the means 402 for securing together a plurality of fencing panels includes the chain 404, the means 402 may further include a chain securing mechanism 410 for securing the non-welded end or portion of the chain after it has been wrapped around a support post of an additional fencing panel. The base of the support post 202 may penetrate into the ground, for example when muddy or on soft soil, in which case a further embodiments of the present disclosure may include a base 414 which resists penetration into the ground. For example the base 414 may be a "j-style" base, as known to those skilled in the art, whereby the support post 202 resists penetration into the ground via a larger surface area of the base 414, advantageously, helping to maintain stability and desired height of the support post 202.

Referring now to FIG. 4B, illustrated is an enlarged portion of the support post 202, arm 212 having holes 214, and chain securing mechanism 410. The chain securing mechanism may be coupled securely to the support post 202 in any variety of ways known to those skilled in the art, one of which including being welded to the support post 202 and/or the arm 212. The chain securing mechanism 410, as depicted, operates to secure the chain via a groove 412 for interlocking with at least one of the chain links 406 (FIG. 4A). Because the chain securing mechanism precludes the chain 404 from moving freely therethrough, the chain is secured at a desired length, thus also securing together the panels it is attached to and secured around.

Advantageously, using a chain as a means for securing together a plurality of fencing panel enables some flexing of the panels and movement with the terrain, while still preventing gaps between the panels. Notably, while the chain 404 and chain securing mechanism 410 are described with respect to the first support post 202, embodiments contemplated herein include where they are arranged on either or both of the support post 202 or 204.

Figure 5:
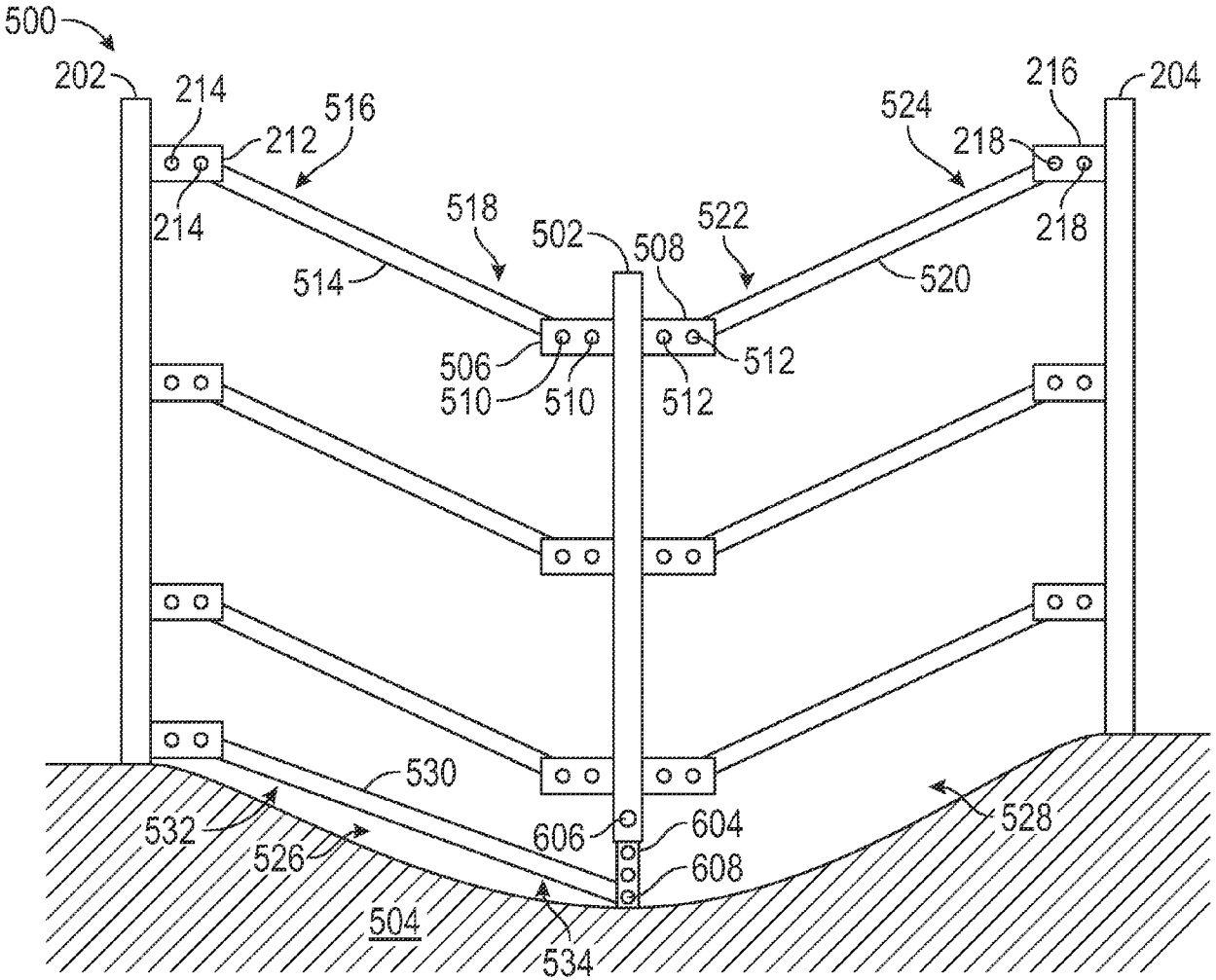
FIG. 5 illustrates a side-view of a fencing panel that includes an intermediate support post, according to one or more embodiments.

FIG. 5 illustrates a side-view of a fencing panel 500 that includes an intermediate support post 502, according to one or more embodiments. The fencing panel 500 is similar to the fencing panel 200 of FIGS. 3-5, and includes a first support 202, as depicted, having four pairs of arms 212 (one labeled), each arm 212 having at least one hole 214 (two holes 214 depicted) therethrough. The fencing panel 500 also includes a second support post 204, as depicted, having three pairs of arms 216 (one labeled), each arm 216 having at least one hole 214 (two depicted) therethrough. However, the fencing panel 500 further includes the intermediate support post 502 arranged between the first support post 202 and second support post 204.

The intermediate support post 502 includes a third pair of arms 506 (three depicted) and a fourth pair of arms 508 (three depicted). In some embodiments, as depicted, the third and fourth pair of arms 506, 508 are radially extending in opposing directions. Each arm of the third pair of arms 506 includes at least one hole 510 (two depicted) therethrough, the holes 510 of each arm being at substantially the same distance from the intermediate support post 502. Similarly, each arm of the fourth pair of arms 508 also includes at least one hole 512 (two depicted) therethrough, the holes 512 of each arm being at substantially the same distance from the intermediate support post 502.

The fencing panel 500 further includes a first crossmember 514 having a first end 516 and a second end 518, and a second crossmember 520 having a first end 522 and a second end 524. The first and second crossmembers 514, 516, accordingly, are similar to the crossmember 206, wherein the end of each crossmember includes a hole (not shown) at each end, thereby enabling coupling of the crossmember to a support post (e.g., support posts 202 or 204) or the intermediate support post 502. Thus, as depicted, the first crossmember 514 is coupled near the first end 516 between the arms 212 of the first support post 202 and near the second end 218 to the third pair of arms 506 of the intermediate post 502, and the second crossmember 516 is coupled at its first end 522 between the fourth pair of arms 508 of the intermediate post 502 and at its second end 524 between the arms 216 of the second support post 204.

Such couplings of the ends of the crossmembers to the arms occurs by a means for coupling the crossmembers to the support posts. Such a means may include, for example and without limitation, a lynch pin which is arranged through the end of the crossmember and the arms, and precluded from removal by attachment of a cotter pin, similar to that described above in FIG. 3. Advantageously, inclusion of the intermediate support post 502 further enables flexibility of the fencing panel 500 over uneven terrain, while still enabling the first and second support posts 202,204 to remain perpendicular. For example, as depicted, the terrain includes a low point or a dip 504. With the intermediate support post 502 being hingedly coupled between the first support post 202 and the second support post 204, the intermediate support post 502 is capable of substantially fencing the dip 504 with the first and second crossmembers 514, 520, thereby precluding animals from entering or exiting therethrough.

It will be appreciated by those skilled in the art that while a single intermediate post 502 is depicted, other embodiments contemplated herein may include a plurality of intermediate posts coupled to each other and arranged between the support posts 202, 204, without departing from the scope of the disclosure.

Figure 6:
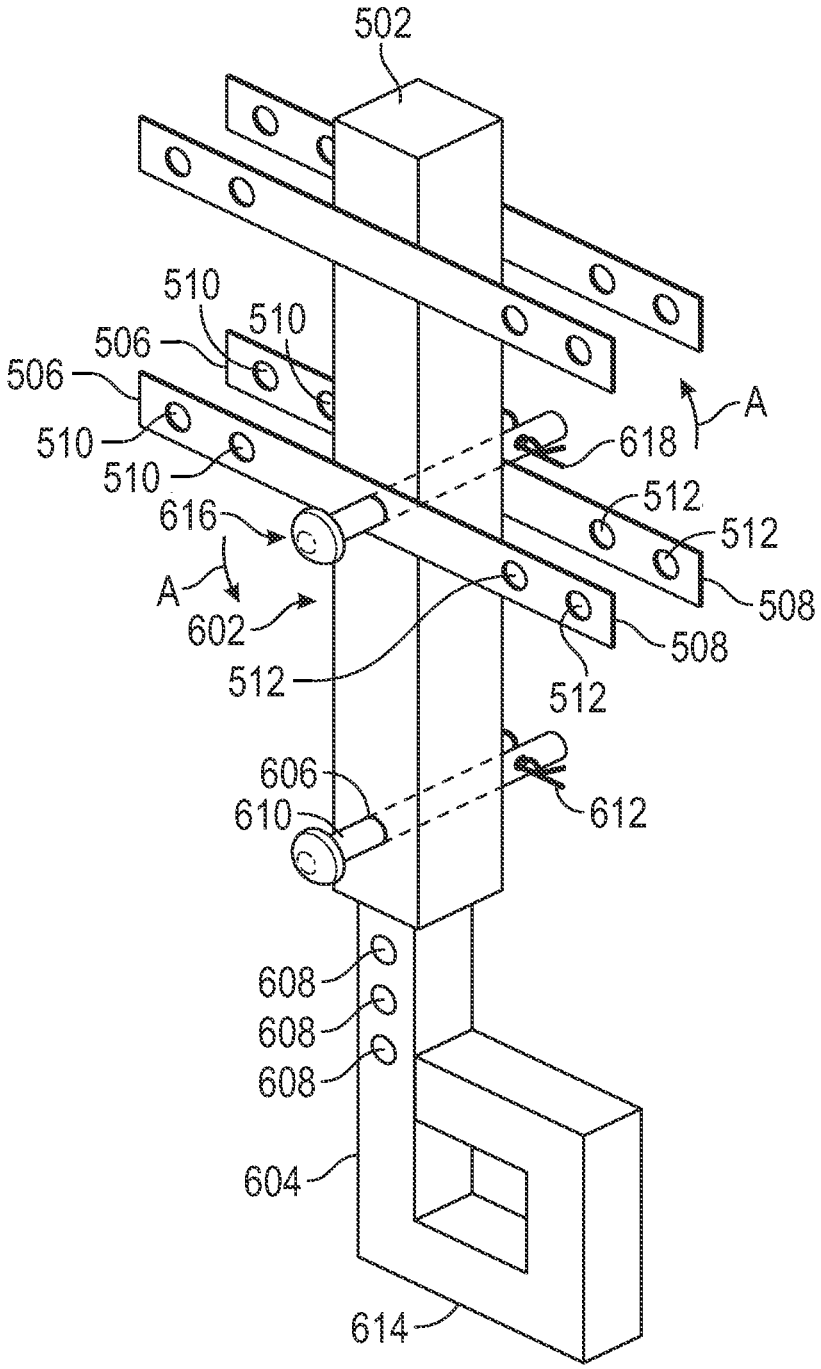
FIG. 6 is an enlarged angled-view of the intermediate support post, according to one or more embodiments.

FIG. 6 is an enlarged angled-view of the intermediate support post 502, according to one or more embodiments. In some embodiments, the intermediate support post 502 may be hollow throughout. In other embodiments, the intermediate support post 502 may include only a bottom portion 602 which is hollow, thereby enabling an extension leg 604 to be inserted or removed therefrom. The bottom portion 602 may include a hole 606, and the extension leg 604 may also include one or more holes 608 (three depicted) therethrough, thus enabling a means for securing the bottom portion to the extension leg at a desired height via the holes 606 and 608. In other embodiments, the extension leg 604 may include a plurality of holes 608 at various heights, thus enabling a variety of corresponding height selections for the intermediate post 502.

In some embodiments, for example and without limitation, the means for securing the bottom portion 602 to the extension leg 604 at a desired height may include a lynch pin 610 and cotter pin 612, similar to those previously described, wherein the lynch pin is arranged through the holes 606 and 608 of the bottom portion 602 and extension leg 604, accordingly.

In other embodiments, the extension leg 604 may include a base portion 614 which resists penetration into the ground, such as by including a larger surface area in contact with the ground, for example, via "j-style" configuration as known to those skilled in the art.

In even further embodiments, the third pair of arms 506 and the fourth pair of arms 508 are hingedly coupled to the intermediate support post 502 via a securing mechanism, for example, a lynch pin 616 and cotter pin 618. Advantageously, such a securing means enables axial movement of the arms 506 and 508, for example, in the direction labeled A (or, alternatively, in a direction opposite of A) thereby enabling further arrangement of the fencing panel 500 to better conform with the terrain and prevent animal pass through.

While inclusion of the extension leg 604 brings the benefits described above, gaps may still be left beneath the crossmembers (e.g. crossmembers 514 and 520) which a user may want to be fenced in. Briefly, referring back to FIG. 5, such gaps are illustrated at areas 526 and 528. However, further embodiments of the fencing panel 500 may prevent such gaps 526, 528 by further including a third crossmember 530 coupled between one of the support posts (as depicted, the first support post 202) and the extension leg 604. The third crossmember 530 includes a first end 532 and a second end 534, each of which includes a hole therethrough.

As depicted, the first end 532 of the third crossmember 530 is coupled to the lowest set of arms 212 of the first support post 202. Such may be accomplished via similar means as previously discussed for coupling a crossmember to one of the support posts, for example, by employing a lynch pin and cotter pin (FIG. 3). However, the second end 534 of the third crossmember 530 is not coupled to the intermediate support post 502, but is coupled to the extension leg 604 via the hole in the second end 534 of the third crossmember 530 and one of the holes 608 in the extension leg. Such an embodiment greatly narrows the gap 526, and thus reduces or precludes animals from passing therethrough.

Figure 7:
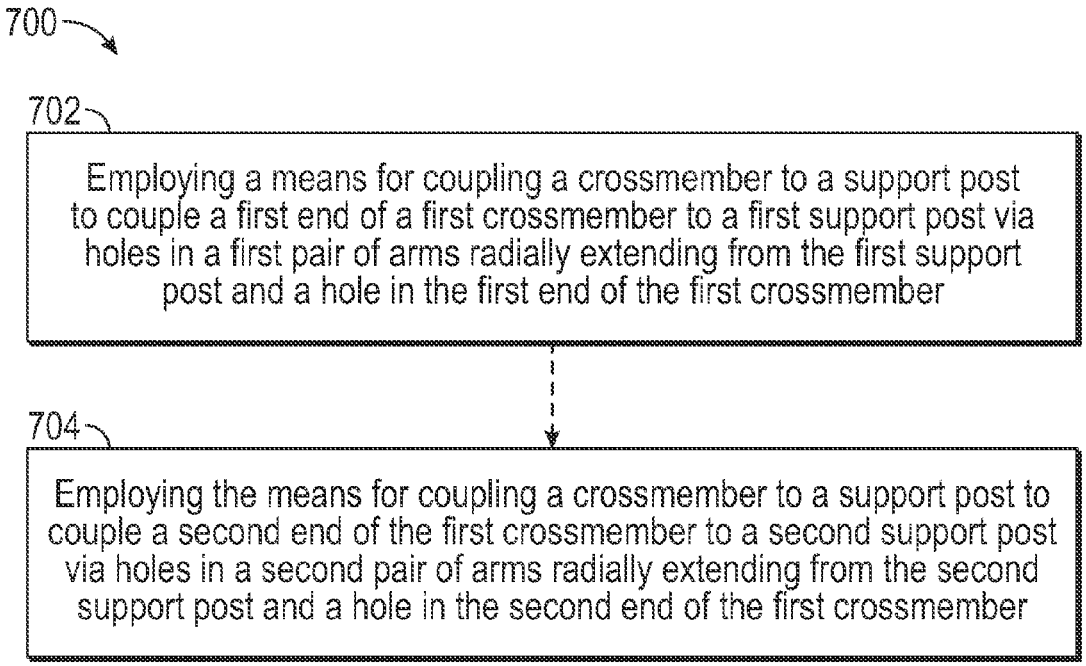
FIG. 7 is a flow diagram of an illustrative method for assembling a fencing panel, according to one or more embodiments.

FIG. 7 is a flow diagram of an illustrative method 700 for assembling a fencing panel, according to one or more embodiments. At block 702, the method 700 employs a means for coupling a crossmember to a support post to couple a first end of a first crossmember to a first support post via holes in a first pair of arms radially extending from the first support post and a hole in the first end of the first crossmember. At block 704, the method 700 further employs the means for coupling a crossmember to a support post to couple a second end of the first crossmember to a second support post via holes in a second pair of arms radially extending from the second support post and a hole in the second end of the first crossmember. Advantageously, such a configuration enables the support posts to remain perpendicular while allowing enhanced contouring of crossmembers with the terrain. In some embodiments, for example and without limitation, the means for coupling a crossmember to a support post includes a lynch pin and cotter pin.

In other embodiments, a means for securing together a plurality of fencing panels is additionally employed, the means being coupled to one of the support posts. For example, such a means may include a chain having a plurality of chain links, where one end of the chain is welded to one of the support posts. Advantageously, such would prevent loss of the chain. Moreover, such a method of welding is animal safe, as there are fewer (if any) sharp edges for an animal to cut themselves on. Even further, with the welded end acting as an anchor, the non-welded end may be wrapped around another fencing panel, and secured to the first fencing panel at a certain length via a means for securing together a plurality of fencing panels, such as interlocking a link of the chain within a groove of a chain securing mechanism coupled to the same support post as the chain.

In further embodiments, an intermediate support post is included between the first and second support posts. The intermediate support post includes a third and fourth set of arms, the arms radially extending therefrom in opposite directions in some embodiments. Each arm of the third and fourth sets of arms includes one or more holes arranged therethrough, the holes of each arm for a pair of arms being arranged at substantially the same location or distance from the intermediate support post.

In some embodiments that include the intermediate support post, the first crossmember is not coupled between the first and second support post, but is coupled between the first support post and the intermediate support post. Thus, the first end of the first crossmember is still coupled to the first support post via the first pair of arms, but the second end of the first crossmember is coupled to the intermediate support post via the holes in the third pair of arms of the intermediate support post and the holes in the second end of the first crossmember. Moreover, the means for coupling a crossmember to a support post may be employed to couple a first end of a second crossmember to the intermediate support post via holes in a fourth pair of arms and a hole in the first end of the second crossmember. Additionally, the means for coupling a crossmember to a support post may be employed to couple the second end of the second crossmember to the second post via the holds in the second pair of arms (of the second post) and a hole in the second end of the second crossmember.

Advantageously, such a configuration may further enable the support posts of the panel to remain perpendicular, while allowing the crossmembers to better remain parallel with the terrain, thereby preventing gaps and animals from moving through such gaps. It will be appreciated by those skilled in the art that while a single intermediate post is described above, further embodiments contemplated herein may include a plurality of intermediate posts arranged between the first and second support posts without departing from the scope of the disclosure.

Providing further flexibility and ability to contour to the terrain, further embodiments of the method 700 may include extending an extension leg from within a bottom portion of the intermediate support post towards the ground and employing a means for securing the bottom portion to the extension leg at a desired height via corresponding holes in the bottom portion and extension leg. Advantageously, such may provide support for all support posts, but the intermediate support post in particular, thereby reducing the stress on all portions of the fencing panel.

Even further embodiments may include employing a second means for coupling the first crossmember to the first pair of arms and the third pair of arms, thereby substantially precluding hinged movement of the first crossmember, but still enabling hinged movement of the second crossmember. In other words, the portion of the fencing panel between the first support post and the intermediate support post would be essentially immobilized, however, the portion of the fencing panel between the intermediate support post and the second support post would continue to be hingedly movable. Such may advantageous to assist stability of the fencing panel on certain terrains.

Although the disclosure has been described and illustrated with respect to exemplary objects thereof, it will be understood by those skilled in the art that various other changes, omissions, and additions may be made therein and thereto without departing from the scope of the present disclosure.

What is claimed is:

1. A fencing panel, comprising:

a first support post having a first pair of arms radially extending therefrom, each arm of said first pair of arms having a plurality of aligned holes horizontally arranged therethrough;

wherein said first support post further comprises first footer means for substantially resisting ground penetration below ground level;

a second support post having a second pair of arms extending therefrom, each arm of said second pair of arms having a plurality of aligned holes horizontally arranged therethrough;

wherein said second support post further comprises second footer means for substantially resisting ground penetration below ground level;

an intermediate support post arranged between said first and second support posts, said intermediate support post having a third and fourth pair of arms, the third and fourth pair of arms radially extending in opposing directions, wherein each arm of said third pair of arms includes a plurality of holes arranged at substantially the same location, and wherein each arm of said fourth pair of arms includes a plurality of holes arranged at substantially the same location;

an extension leg having a plurality of holes therethrough and arranged at least partially within a bottom portion of the intermediate support post and configured to extend from said bottom portion towards the ground;

extension leg securing means for securing said bottom portion to said extension leg at a desired height via a first hole in said bottom portion and one of said plurality of holes in said extension leg;

a first crossmember having a first crossmember first end and a first crossmember second end, each of said first crossmember first end and said first crossmember second end having a horizontal hole therethrough;

first coupling means for pivotally joining said horizontal hole of said first crossmember first end to said first pair of arms of said first support post;

second coupling means for pivotally joining said horizontal hole of said first crossmember second end to said third pair of arms of said intermediate support post, wherein said first coupling means and said second coupling means enable dynamic crossmember adjustability of said first crossmember;

a second crossmember having a second crossmember first end and a second crossmember second end, each of said second crossmember first end and said second crossmember second end having a horizontal hole therethrough;

third coupling means for pivotally joining said horizontal hole of said second crossmember first end to said fourth pair of arms of said intermediate support post;

fourth coupling means for pivotally joining said horizontal hole of said second crossmember second end to said second pair of arms of said second support post, wherein said third coupling means and said fourth coupling means enable dynamic crossmember adjustability of said second crossmember, wherein said plurality of holes of said first pair of arms and said plurality of holes of said third pair of arms allows for varying the distance between said first support post and said intermediate support post when said first crossmember is pivotally joined therebetween, wherein said plurality of holes of said fourth pair of arms and said plurality of holes of said second pair of arms allows for varying the distance between said intermediate support post and said second support post when said second crossmember is pivotally joined therebetween, said first support post further comprising a fifth pair of arms arranged closer to the ground than said first pair of arms, each arm of said fifth pair of arms having a plurality of aligned holes horizontally arranged therethrough; and a third crossmember having a third crossmember first end having a horizontal hole therethrough and a third crossmember second end having a horizontal hole therethrough, wherein said third crossmember first end is pivotally joined to said fifth pair of arms, and said third crossmember second end is pivotally joined to one of said plurality of holes of said extension leg, thereby decreasing clearance to the ground.

2. The fencing panel of claim 1, wherein the first and second coupling means each comprises a lynch pin and cotter pin, wherein said lynch pin and said cotter pin enable adjustable positioning of said horizontal holes in said first crossmember first and second end with any of said plurality of holes in said associated first pair of arms and second pair of arms.

3. The fencing panel of claim 1, further comprising fencing panel securing means for securing together a plurality of fencing panels, the fencing panel securing means being coupled to one of the first or second support posts.

4. The fencing panel of claim 3, wherein the fencing panel securing means for securing together a plurality of fencing panels comprises a chain having a plurality of chain links, wherein a first chain link of the plurality of chain links is coupled to the first or second support posts via a weld.

5. The fencing panel of claim 4, further comprising chain securing means for interlocking with a second chain link of the plurality of chain links, wherein said chain securing means is coupled to said first support post.

6. The fencing panel of claim 1, wherein the third and fourth pair of arms are hingedly coupled to the intermediate support post via a securing mechanism.

7. The fencing panel of claim 1, further comprising:

fifth coupling means for said pivotally joining said third crossmember first end to said fifth support post; and sixth coupling means for said pivotally joining said third crossmember second end to one of said plurality of holes of said extension leg.

* * * * *